US005386115A

United States Patent [19]

Freidhoff et al.

[11] Patent Number: 5,386,115

[45] Date of Patent: Jan. 31, 1995

[54] SOLID STATE MICRO-MACHINED MASS SPECTROGRAPH UNIVERSAL GAS DETECTION SENSOR

[75] Inventors: Carl B. Freidhoff, Murrysville; Robert M. Young, Pittsburgh; Saptharishi Sriram, Monroeville, all of Pa.

[73] Assignee: Westinghouse Electric Corporation, Pittsburgh, Pa.

[21] Appl. No.: 124,873

[22] Filed: Sep. 22, 1993

[51] Int. Cl.[6] ..... D01D 59/44; H01J 49/00

[52] U.S. Cl. ..... 250/281; 250/427

[58] Field of Search ..... 250/281, 282, 427

[56] References Cited

U.S. PATENT DOCUMENTS

| | | | |
|---|---|---|---|
| 3,555,273 | 1/1971 | Arnold | 250/41.9 |
| 3,925,662 | 12/1975 | Dawson | 250/290 |
| 4,850,371 | 7/1989 | Broadhurst et al. | 128/719 |
| 4,866,267 | 9/1989 | Matsuda et al. | 250/296 |
| 4,885,500 | 12/1989 | Hansen et al. | 313/256 |
| 4,947,041 | 8/1990 | Tava | 250/298 |
| 4,948,962 | 8/1990 | Mitsui et al. | 250/288 |
| 4,966,141 | 10/1990 | Bacaner et al. | 128/207 |
| 4,994,676 | 2/1991 | Mount | 250/299 |
| 4,996,422 | 2/1991 | Mitsui et al. | 250/281 |
| 4,996,424 | 2/1991 | Mimura et al. | 250/288 |
| 5,015,845 | 5/1991 | Allen et al. | 250/288 |
| 5,015,848 | 5/1991 | Bomse et al. | 250/281 |
| 5,026,987 | 6/1991 | Bier et al. | 250/281 |
| 5,036,195 | 7/1991 | Batev et al. | 250/288 |
| 5,043,576 | 8/1991 | Broadhurst et al. | 250/281 |
| 5,072,115 | 12/1991 | Zhou | 250/281 |
| 5,091,645 | 2/1992 | Elliott | 250/295 |

OTHER PUBLICATIONS

Microminiaturization of Electron Optical Systems, T. H. P. Chang, et al. J. Vacuum Sci. & Tech. (B), vol. 8, No. 6; Nov. Dec. 1990; pp. 1698–1705.

High-Energy Product Sm-Co-Based Sputtered Films, Crystal Texturing, and Magnetic Properties; F. J. Cadieu, et al.; J. Appl. Phys. 67(a), 1 May 1990 pp. 4969–4971.

*Primary Examiner*—Bruce C. Anderson

[57] ABSTRACT

A solid state mass spectrograph includes an inlet, a gas ionizer, a mass filter and a detector array all formed within a cavity in a semiconductor substrate. The gas ionizer can be a solid state electron emitter with ion optics provided by electrodes formed on apertured partitions in the cavity forming compartments through which the cavity is evacuated by differential pumping. The mass filter is preferably a Wien filter with the magnetic field provided by a permanent magnet outside the substrate or by magnetic film on the cavity walls. The electric field of the Wien filter is provided by electrodes formed on walls of the cavity. The detector array is a linear array oriented in the dispersion plane of the mass filter and includes converging electrodes at the end of the cavity serving as Faraday cages which pass charge to signal generators such as charge coupled devices formed in the substrate but removed from the cavity.

20 Claims, 6 Drawing Sheets

FIG. 8
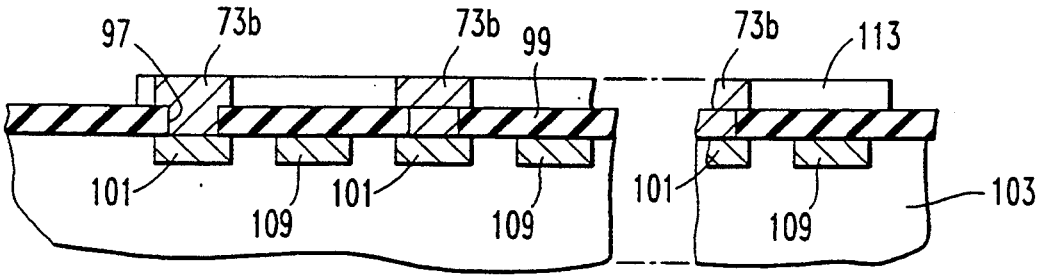
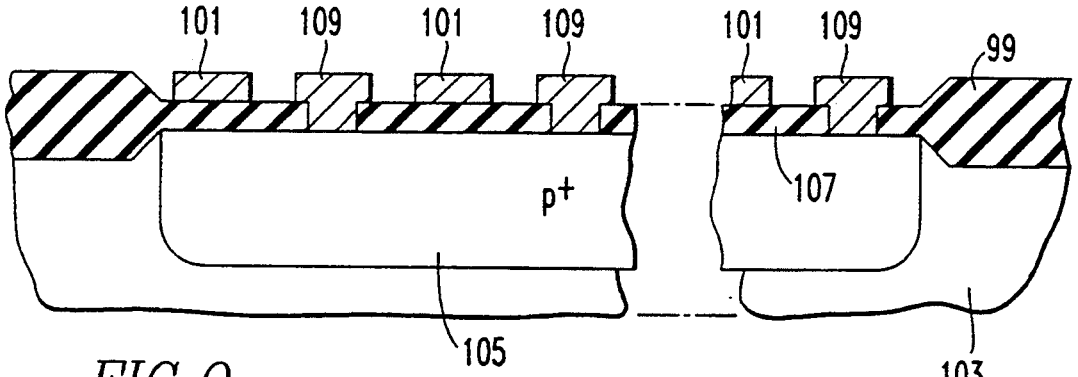
FIG. 9
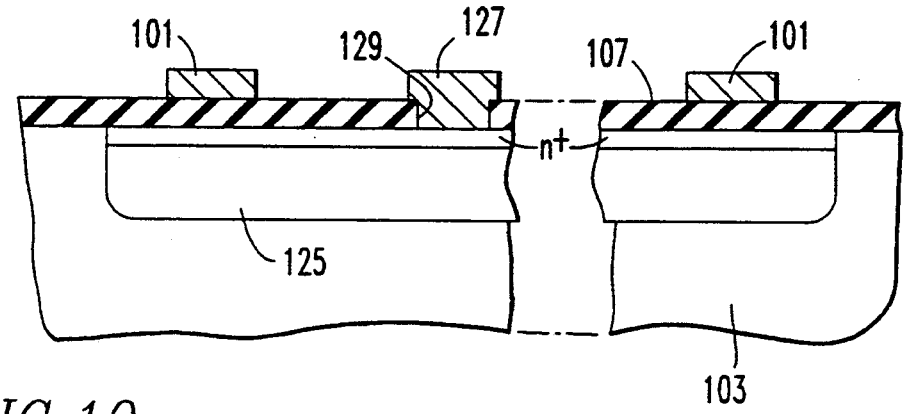
FIG. 10

SOLID STATE MICRO-MACHINED MASS SPECTROGRAPH UNIVERSAL GAS DETECTION SENSOR

The Government of the United States of America has rights in this invention pursuant to Contract No. 92-F-141500-000, awarded by the U.S. Department of Defense, Defense Advanced Research Projects Agency.

BACKGROUND OF THE INVENTION

1. Field of the Invention

This invention relates to a gas-detection sensor and more particularly to a solid state mass spectrograph which is micro-machined on a semiconductor substrate.

2. Background Information

Various devices are currently available for determining the quantity and type of molecules present in a gas sample. One such device is the mass-spectrometer.

Mass-spectrometers determine the quantity and type of molecules present in a gas sample by measuring their masses. This is accomplished by ionizing a small sample and then using electric and/or magnetic fields to find the charge-to-mass ratio of the ion. Current mass-spectrometers are bulky, bench top-sized instruments. These mass spectrometers are heavy (100 pounds) and expensive. Their big advantage is that they can be used in any environment.

Another device used to determine the quantity and type of molecules present in a gas sample is a chemical sensor. These can be purchased for a low cost, but these sensors must be calibrated to work in a specific environment and are sensitive to a limited number of chemicals. Therefore, multiple sensors are needed in complex environments.

A need exists for a low-cost gaseous detection sensor that will work in any environment.

SUMMARY OF THE INVENTION

This need and others are satisfied by the invention which is directed to a solid state mass spectrograph which is implemented on a semiconductor substrate. The semiconductor substrate is micro-machined to form a cavity which has an inlet, and a gas ionizing section adjacent the inlet, followed by a mass filter section, which in turn is followed by a detector section. A vacuum means evacuates the cavity and draws a sample gas into the cavity through the inlet. Gas ionizing means formed in the gas ionizing section of the cavity in the substrate ionizes the sample gas drawn into the cavity through the inlet. The ionized gas passes into mass filter means formed in the mass filter section of the cavity. This mass filter, which is preferably a Wien filter, filters the ionized gas by mass/charge ratio. Detector means in the detector section of the cavity detect this mass/charge ratio filtering of the ionized sample gas. Preferably, the detector means simultaneously detects a plurality of the gas constituents in the sample gas and comprises an array of detector elements. More particularly, a linear array of detector elements lies in the plane in which the mass filter disperses ions of the sample gas based upon their mass/charge ratio. The detector array is located at the end of the cavity in the substrate and has pairs of converging electrodes formed on the substrate which serve as Faraday cages to gather ions for application to detector cells which are preferably charge coupled devices located in the substrate outside the cavity.

In the preferred form of the invention, the substrate is formed in two parts joined along parting surfaces extending through the cavity. The detector cells are formed in a recess in the parting surface of one of the halves of the semiconductor substrate.

The cavity in the semiconductor substrate is divided by partitions into a number of compartments with aligned apertures providing a path for the sample gas to pass from the inlet, through the ionizer, and into the mass filter. A vacuum is drawn from each of these compartments to effect differential pumping which reduces the capacity required of the vacuum pump.

The gas ionizer is preferably a solid state electron emitter formed in the substrate in the gas ionizing section of the cavity. Electrodes formed on the apertured partitions between the electron emitter and the mass filter serve as ion optics which accelerate and focus the ions into a beam for introduction into the mass filter.

As mentioned, the mass filter is preferably a Wien filter. The magnetic field can be generated by permanent magnets surrounding the semiconductor substrate or by magnetic films formed on the walls of the cavity. The electric field of the Wien filter is generated by electrodes formed on opposite walls of the cavity in the filter section. The solid state mass spectrograph of the invention is a small, low power, easily transportable versatile device which can detect multiple constituents of a sample gas simultaneously. When produced in sufficient quantity, it will be a low cost sensor which will find wide application.

BRIEF DESCRIPTION OF THE DRAWINGS

A full understanding of the invention can be gained from the following description of the preferred embodiments when read in conjunction with the accompanying drawings in which:

FIG. 8 is a partial cross-sectional view through the detector array taken along the line 8—8 in FIG. 7.

FIG. 9 is a partial cross-sectional view through the detector array taken along the line 9—9 in FIG. 7.

FIG. 10 is a partial cross-sectional view through the detector array taken along the line 10—10 in FIG. 7.

DESCRIPTION OF THE PREFERRED EMBODIMENTS

Figure 1:
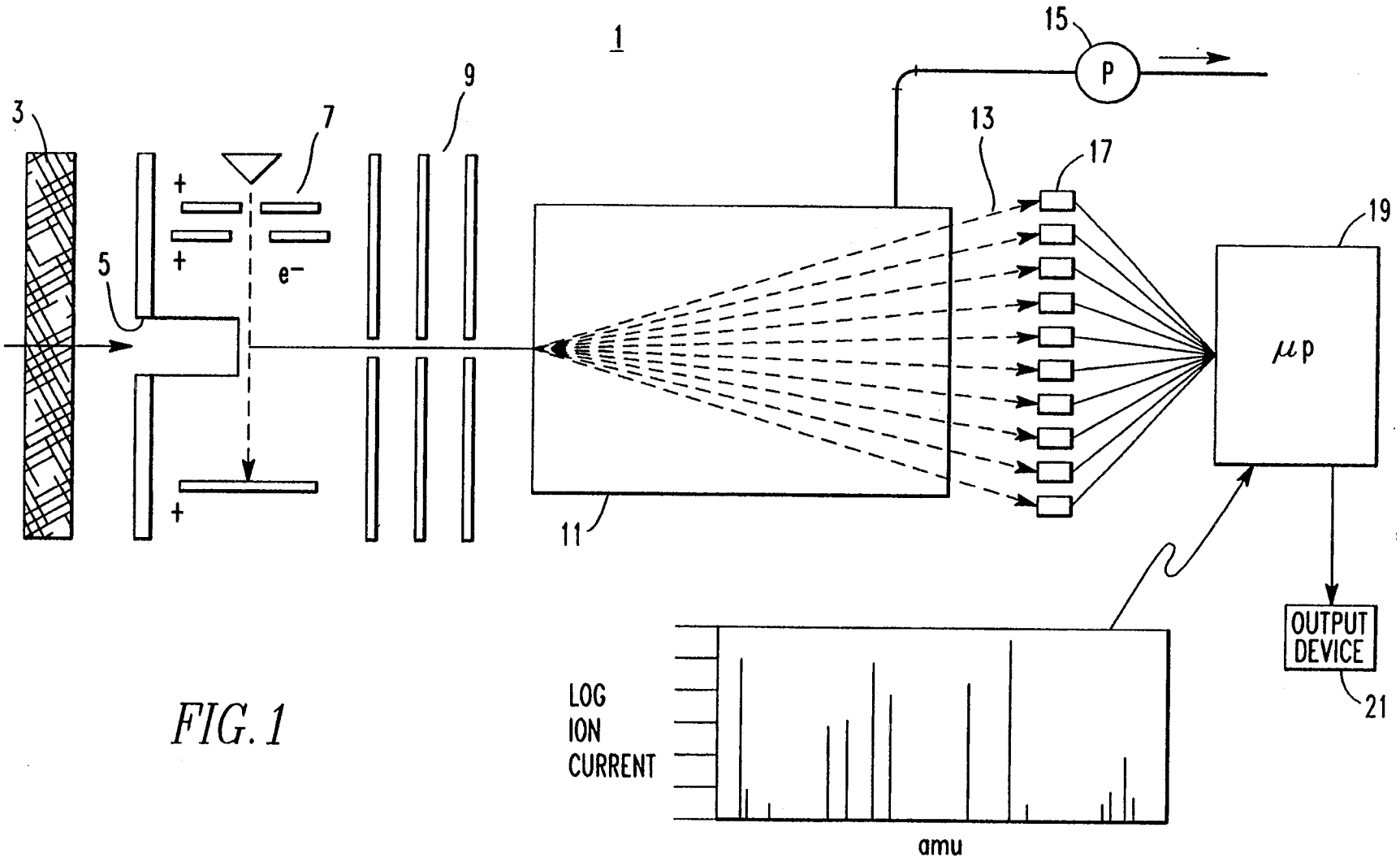
FIG. 1 is a functional diagram of a solid state mass spectrograph in accordance with the invention.

A functional diagram of the spectrograph 1 of the invention is illustrated in FIG. 1. This mass spectrograph 1 is capable of simultaneously detecting a plurality of constituents in a sample gas. The sample gas enters the spectrograph 1 through dust filter 3 which keeps particulates from clogging the gas sampling path. The sample gas then moves through a sample orifice 5 to a gas ionizer 7 where it is ionized by electron bombardment, energetic particles from nuclear decays or-in a radio frequency induced plasma. Next, ion optics 9 accelerate and focus the ions through a mass filter 11. The mass filter 11 applies a strong electromagnetic field to the ion beam. Mass filters which utilize primarily magnetic fields appear to be the best suited for the miniature mass spectrograph of the invention since the required magnetic field of about one Tesla (10,000 Gauss) is easily achieved in a compact, permanent magnet design. Ions of the sample gas that are accelerated to the same energy will describe circular paths when exposed in the mass filter 11 to a homogeneous magnetic field perpendicular to the ion's direction of travel. The radius of the arc of the path is dependent upon the ion's mass-to-charge ratio. In the preferred embodiment of the invention, the mass filter 11 is a Wien filter in which crossed electrostatic and magnetic fields produce a constant velocity-filtered ion beam 13 in which the ions are dispersed according to their mass/charge ratio in a dispersion plane which is in the plane of FIG. 1. Alternatively, a magnetic sector could be used for the mass filter 11; however, the Wien filter is more compact and additional range and resolution can be obtained by sweeping the electric field.

A vacuum pump 15 creates a vacuum in the mass filter 11 to provide a collision-free environment for the ions. This is needed to prevent error in the ions trajectories due to these collisions.

The mass-filtered ion beam is collected in an ion detector 17. This ion detector 17 is a linear array of detector elements which makes possible the simultaneous detection of a plurality of the constituents of the sample gas. A microprocessor 19 analyzes the detector output to determine the chemical makeup of the sampled gas using well-known algorithms which relate the velocity of the ions and their mass. The results of the analysis generated by the microprocessor 19 are provided to an output device 21 which can comprise an alarm, a local display, a transmitter and/or data storage. The display can-take the form shown at 21 in FIG. 1 in which the constituents of the sample gas are identified by the lines measured in atomic mass units (AMU).

Figure 2:
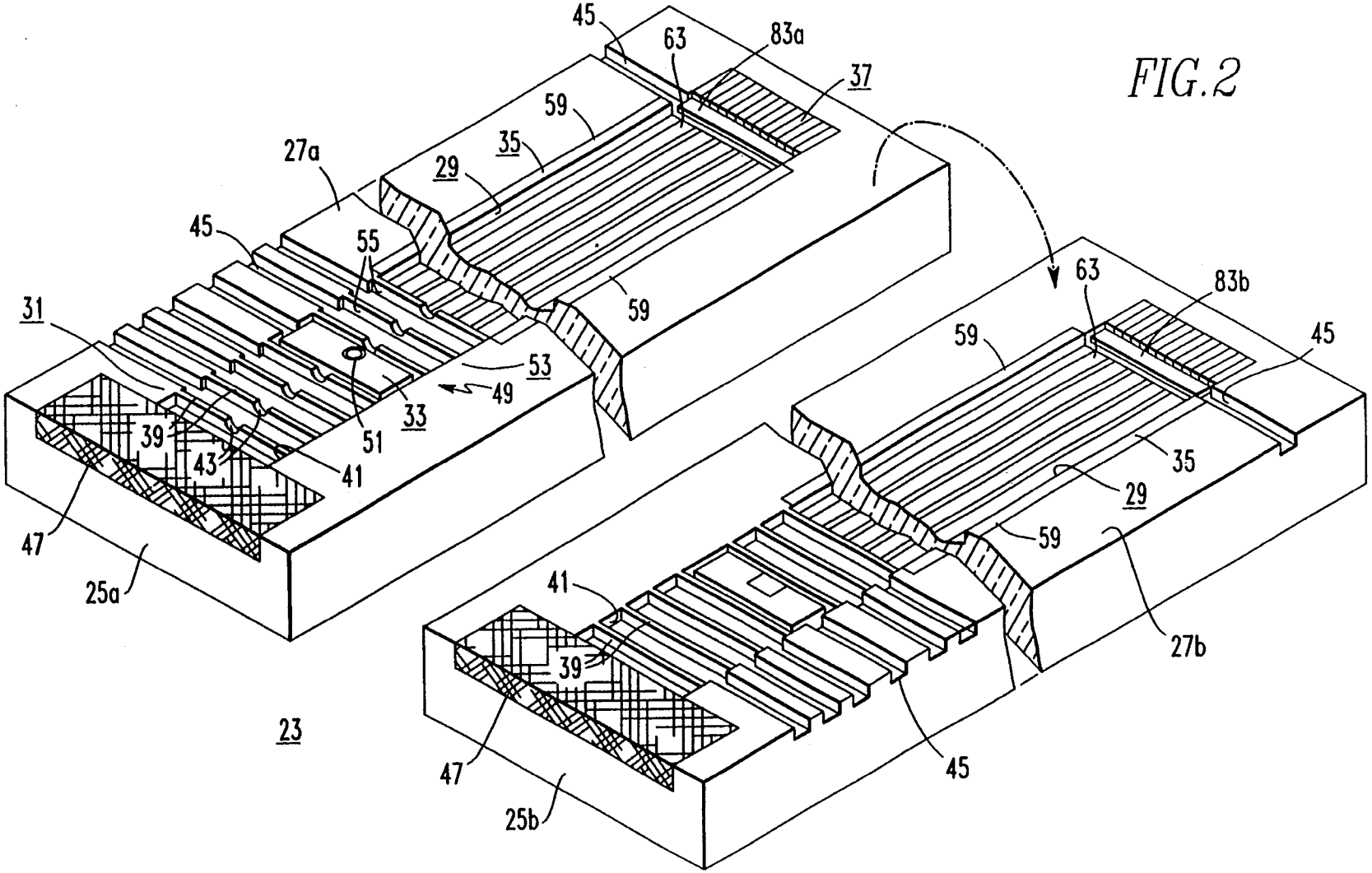
FIG. 2 is an isometric view of the two halves of the mass spectrograph of the invention shown rotated open to reveal the internal structure.

The mass spectrograph 1 is implemented in a semiconductor chip 23 as illustrated in FIG. 2. In the exemplary spectrograph 1, the chip 23 is about 20 mm long, 10 mm wide and 0.8 mm thick. This chip 23 comprises a substrate of semiconductor material formed in two halves **25*a* and 25*b* which are joined along longitudinally extending parting surfaces 27A and 27*b*. The two substrates halves 25*a* and 25*b* form at their parting surfaces 27*a* and 27*b* an elongated cavity 29. This cavity 29 has an inlet section 31, a gas ionizing section 33, a mass filter section 35 and a detector section 37. A number of partitions 39 formed in the substrate extend across the cavity 29 forming chambers 41. These chambers are interconnected by aligned apertures 43 in the partitions 39 in the half 25*a* which define the path of the gas through the cavity 29. The vacuum pump 15, shown in FIG. 1, is connected to each of the chambers 41 through lateral passages 45 formed in the confronting surfaces 27*a* and 27*b*. This arrangement provides differential pumping of the chambers 41** and makes it possible to achieve the pressures required in the mass filter and detector sections with a miniature vacuum pump. As mentioned previously, any collision between an ion and a gas molecule will randomize the ion's trajectory reducing the desired ion current and raising the background. The mean free path is the average distance that a gas molecule travels under conditions of temperature and pressure before encountering another gas molecule. The mean-free path of a gas molecule in air at ambient temperature is about 1 cm at a pressure on the order of 10 mTorr.

The inlet section 31 of the cavity 29 is provided with a dust filter 47 which can be made of porous silicon or sintered metal. The inlet section 31 includes several of the apertured partitions 39 and; therefore, several chambers 41.

The gas ionizing section 33 of the cavity 29 houses a gas ionizing system 49 which includes a gas ionizer 51 and ionizer optics 53. The gas sample drawn into the mass spectrograph 1 consists of neutral atoms and molecules. To be sensed, a fraction of these neutrals must be ionized. Different ionization schemes exist, such as photo-ionization, field ionization or chemical ionization; however, the most commonly used ionization technique in mass spectrometers and spectrographs is ionization by electronic impact. In this technique, an electron gun (e-gun) accelerates electrons which bombard the gas molecules and disassociatively ionize them.

The most common electron emitter in mass spectrometers uses refractory metal wire which when heated undergoes thermionic electronic emission. These can be scaled down using photolithrography to micron sized dimensions. However, thermionic emitters require special coatings to resist oxidation and are power hungry, but are capable of producing relatively large amounts of electron current, approximately 1 mA.

Due to the sensitivity of the detectors used in the subject spectrograph to be discussed below, and to the higher gas pressure in the ionization section made possible by the differential vacuum pumping, much smaller electron beam currents, about 1 $\mu$A are required of the e-gun. Two emitters developed by the assignee of the subject invention can meet this requirement. The first is the field effect cold cathode emitter which uses a sharpened point or edges to create a high electric field region which enhances electron emission. Such cathodes have been tested up to 50 $\mu$A beam current, and are readily fabricated by semi-conductor lithographic techniques. One disadvantage of field emission cold cathode is the tendency to foul frown contaminants in the test gas, therefore, differential pumping of the cathode would be required. The second e-gun scheme is the reverse bias p-n junction which is less prone to fouling and is, therefore, the preferred electron emitter for the spectrograph of the invention. The reverse bias p-n junction sends an electron current racing through the solid state circuit. Near the surface, the very shallow junction permits a fraction of a highest energy of-electrons to escape into the vacuum. Such small electron currents are required that a thin gold film will produce the desired emissions over a long time.

The ion optics 53 comprise electrodes 55 on several of the apertured partitions 39, The ion optics 53 accelerate the ions and collimate the ion beam for introduction into the mass filter 11.

Figure 3:
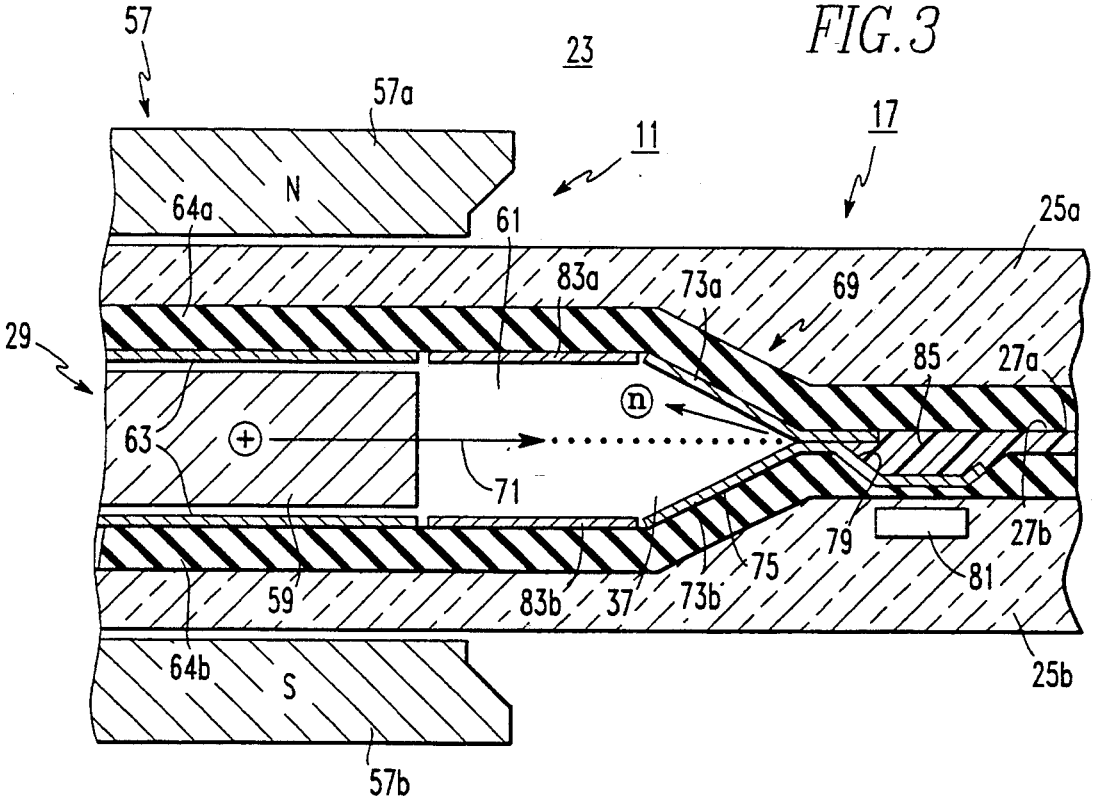
FIG. 3 is a longitudinal fractional section through a portion of the mass spectrograph of the invention.

The mass filter 11 is located at the mass filter section 35 of the cavity 29. The preferred embodiment of the invention utilizes a permanent magnet 57 which reduces power consumption. This permanent magnet 57 has upper and lower pole pieces **57*a* and 57*b*, see FIG. 3, which straddle the substrate halves 25a and 25b and produce a magnetic field which is perpendicular to the path of the ions. The orthogonal electric field for the Wien filter used in the preferred embodiment of the invention is produced by opposed electrodes 59 formed on the side walls 61 of the mass filter section 35 of the cavity 29. As shown in FIGS. 2 and 3, additional pairs of opposed trimming electrodes 63 are spaced along the top and bottom walls of the mass filter section 35 of the cavity 29. A spectrum of voltages is applied to these additional electrodes to make the electric field between the electrodes 59 uniform. These additional electrodes 63 are made of non-magnetic, electrically conductive material such as gold so that they do not interfere with the magnetic field produced by the permanent magnet 57. These electrodes 63 are deposited on an insulating layer of silicon dioxide 64a and 64b lining the cavity 29**.

Figure 4:
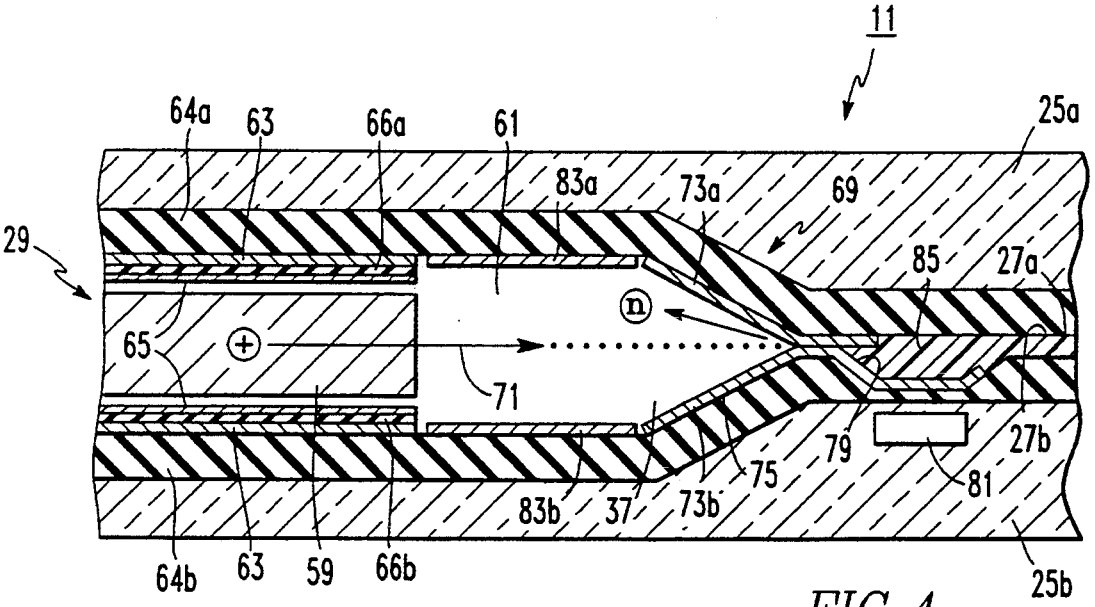
FIG. 4 which is similar to FIG. 3, illustrates another embodiment of the invention.

As an alternative to the permanent magnet 57, the magnetic field for the mass filter 11 can be generated by a magnetic film 65 deposited on the insulating silicon dioxide layers 64a and 64b on the top and bottom walls of the mass filter section 35 of the cavity 29 as shown in FIG. 4. In this embodiment, the electric field trimming electrodes 63 are deposited on an insulating layer of silicon dioxide 66a and 66b covering the magnetic film 65.

The ion detector 17 is a linear array 67 of detector elements 69 oriented in the dispersion plane 71 (perpendicular to the planes of FIGS. 3 and 4) at the end of the detector section 37 of the cavity 29. The exemplary array 67 has 64 detector elements or channels 69. The detector elements 69 each include a Faraday cage formed by a pair of converging electrodes 73a and 73b formed on the surfaces of a v-shaped groove 75 formed in the end of the cavity 29. The Faraday cages increase signal strength by gathering ions that might be slightly out of the dispersion plane 71, through multiple collisions.

The electrodes 73a and 73b of the Faraday cage extend beyond the end of the cavity 29 along the parting surfaces 27a and 27b of the substrate halves 29a and 29b. These electrodes 73a and 73b are plated onto the insulating layers 64a and 64b of silicon dioxide formed in the two substrate halves 25a and 25b. The electrode 73b extends into a recess 79 in the insulating silicon dioxide layer 77b to form a capacitor pad for a charge coupled device (CCD) or metal oxide semiconductor (MOS) switch device 81 formed in the substrate half 25b. The ions are dispersed by the mass filter 11 in the dispersion plane 71 to strike a detector element as determined by their mass/charge ratio. When the ion strikes the electrode 73a or 73b of the detector element 69, its charge is neutralized. The charge required to neutralize the ion is read out by the CCD or MOS 81.

Isolating electrodes 83a and 83b extend transversely across the upper and lower walls of the cavity 29 between the detector electrodes 73 and the electrodes of the mass filter section. These electrodes 83a and 83b are grounded to isolate the detector elements from the fields of the mass filter. A sealant 85 fills the recess 79 and joins the two substrate halves 25a and 25b.

Figure 5:
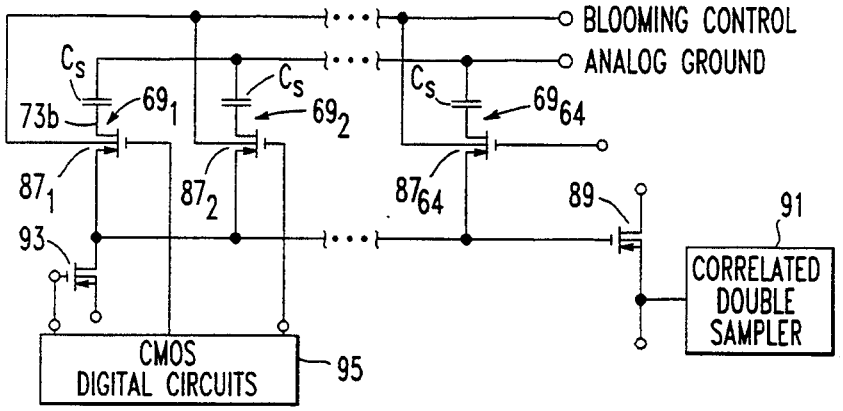
FIG. 5 is a schematic circuit diagram of the multichannel detector array which forms part of the mass spectrograph of the invention.

FIG. 5 shows the circuit arrangement for multiplexed operation of an ion detector array 67. In this scheme, the ions are incident on one electrode of the capacitors, $C_S$ of the detector elements 69. The ionic charge is neutralized by the sensor capacitor electrodes 73b leaving behind a net positive charge on the sensor capacitors, $C_S$. The total ionic charge on each capacitor $C_S$ is integrated over an integration period, for example, 90 msec in the exemplary embodiment of the invention. During this time, multiplexer switches $87_{1-64}$ shown in FIG. 5 are in the off condition and are designed to provide very low leakage to improve the sensitivity of detection. At the end of the integration period the multiplexer switches are sequentially turned on to discharge the accumulated charge on the sensor capacitors onto the much larger gate capacitance of an electrometer amplifier FET 89. The change in gate voltage due to these additional charges is amplified and converted to an output current signal by the electrometer 89. To improve the sensitivity of detection it is necessary to minimize the noise introduced by the electrometer 89 and the multiplexer switches 87 in the circuit. For this reason, P-channel MOSFETs were chosen for these devices since they have much lower noise than N-channel devices. To further reduce noise and minimize the effect of switching transients a technique called Correlated Double Sampling (CDS) 91 is used, to process the output current signal from the electrometer.

Figure 6:
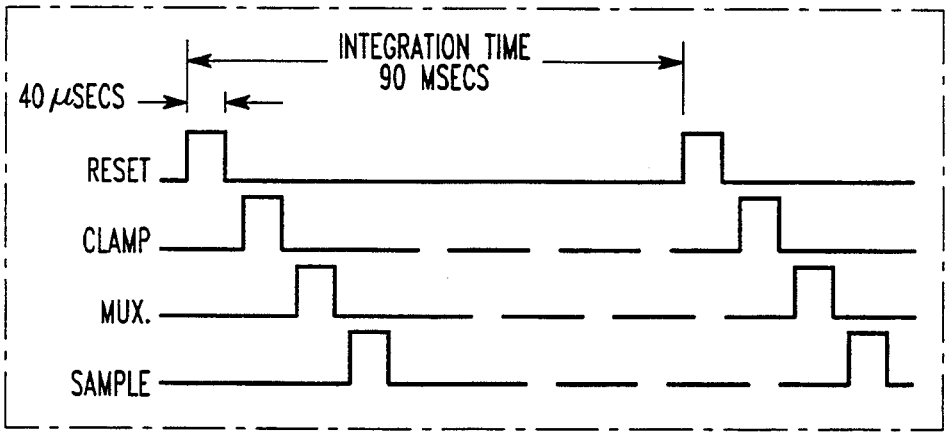
FIG. 6 is a waveform diagram illustrating operation of the multichannel detector array of FIG. 5.

The CDS scheme utilizes a four cycle operation for signal readout as shown in the timing diagram of FIG. 6. In this scheme the gate of the electrometer 89 is first reset to a reference voltage $V_R$ by turning a reset switch 93 on during a reset period. At the end of the reset period, the gate voltage of the electrometer 89 is slightly different from $V_R$ due to noise and switching transients. For this reason the output current of the electrometer 89 is measured during a clamp period and stored in offchip capacitors. The next operation is to turn one of the multiplexer switches 87 on to discharge the integrated charge on the sensor capacitor onto the electrometer gate. The output current of the electrometer 89, which is dependent on the amount of charge discharged into the gate, is then measured during the sampling period. The difference in the output current values obtained in the sampling and clamp periods is proportional to the integrated ionic charge which is the desired signal. This four cycle operation is then repeated for the remainder of the array. The differencing procedure used in CDS substantially reduces switching transient effects, reduces reset noise, and also reduces noise arising from the electrometer 89.

The various timing signals required for the detector array can be generated with digital circuits 95 preferably made with CMOS to reduce power dissipation. In the exemplary embodiment of the invention, dynamic shift registers have been used to generate the multiplexer timing signals. Off-chip circuitry is used to generate the remaining control signals such as the blooming control signal which limits the amount of charge .which can reside on a sensor capacitor, so that small signals on adjacent sensor capacitors can be determined without cross talk interference from charges induced from high signal sensor capacitors.

Figure 7:
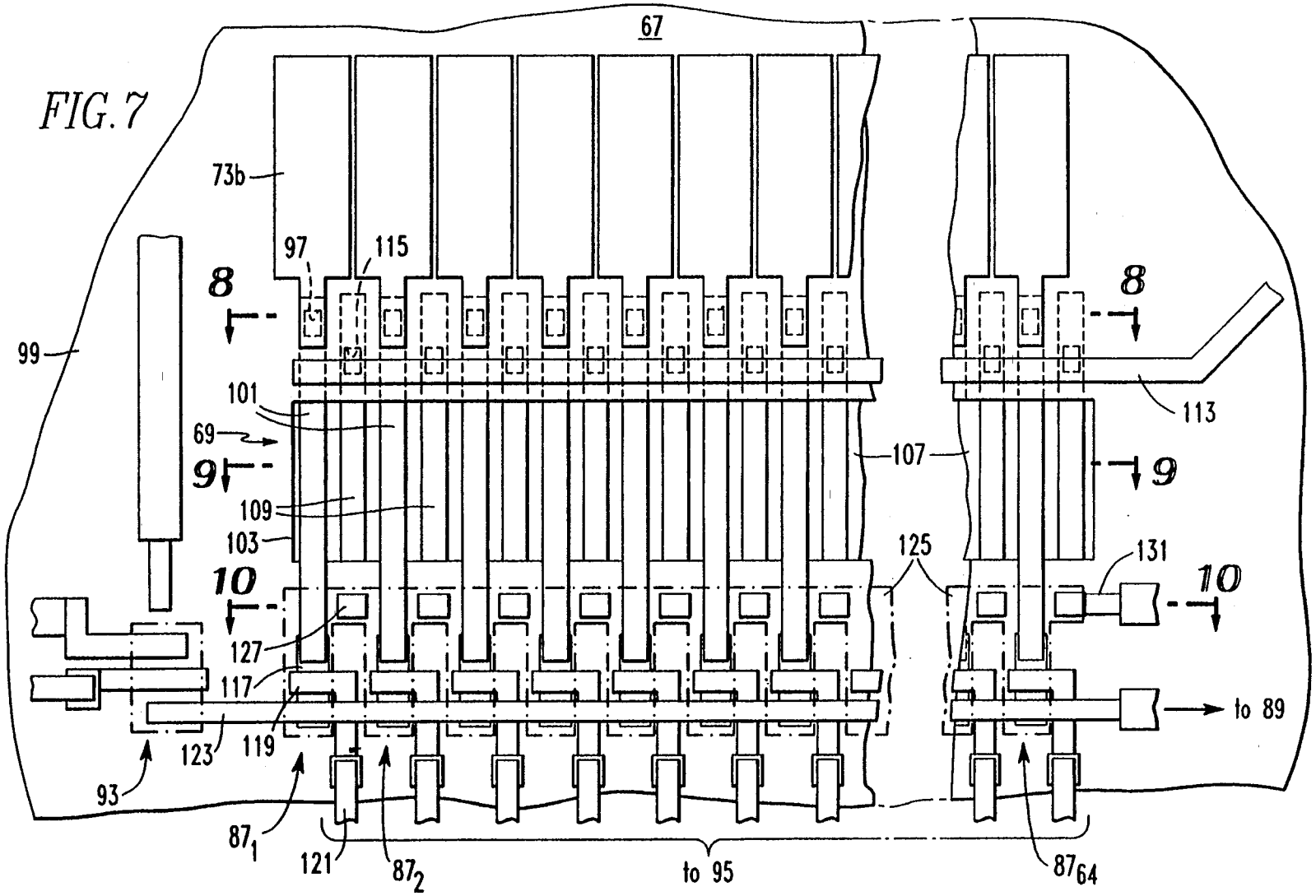
FIG. 7 is a plan view of a portion of the detector array implemented on a semiconductor substrate.

A plan view of one embodiment of the linear detector array 67 is shown in FIG. 7. As can be seen from FIGS. 7 and 8, the Cr/Au ion sensor metal 73b which forms one/half of the Faraday cage for each of the sensor elements 69 extends through via opening 97 in a dielectric layer 99 on the chip to contact an aluminum metal lead 101 embedded in the substrate 103. As shown in FIGS. 7 and 9 lead 101 extends over a p+implant region 105 and is separated therefrom by a thin, such as 1,000–3,000 angstrom thick, dielectric layer 107. The lead 101 forms one plate, and the p+implant 105 forms the other plate of the capacitor $C_S$. The p+implant 105 is connected to ground through an aluminum ground contact lead 109 which extends parallel to the lead 101. The p+implant 105 is formed in the substrate 103 and is electrically connected to the ground contact lead 109 through an opening in the dielectric layer 107. In the exemplary embodiment of the invention, the field oxide layer 99 is silicone dioxide about 8,000 angstroms thick.

As can be seen from FIG. 7, all of the ground contacts 109 from each of the detector elements 69 are connected to a transverse ground lead 113 through via openings 115.

The aluminum lead 101 for each of the detector elements 69 extends to and contacts a p+implant 117 of the P-channel MOSFET multiplexer switch 87. The gate electrode 119 of each of the switches 187 is connected to a lead 121 which extends to the CMOS control circuit 95. The p+implant regions 117 of all of the switches 87 are connected by a common lead 123 to the reset switch 93 which is also a P-channel MOSFET. The lead 123 is also connected to the gate of the electrometer amplifier FET 89.

The n-wells of all of the P-channel MOSFET multiplexer switches 87 identified by the reference character 125 are joined as shown in FIGS. 7 and 10 at one end. As shown in FIG. 10, aluminum contacts 127 are provided at openings 129 in the oxide layer 107 to reduce the electrical resistance across the connected n-wells. An n+layer improves electrical contact between the n-wells 125 and the aluminum contacts 127. A lead 131 connected to the n-wells carries the blooming control signal.

Figure 11:
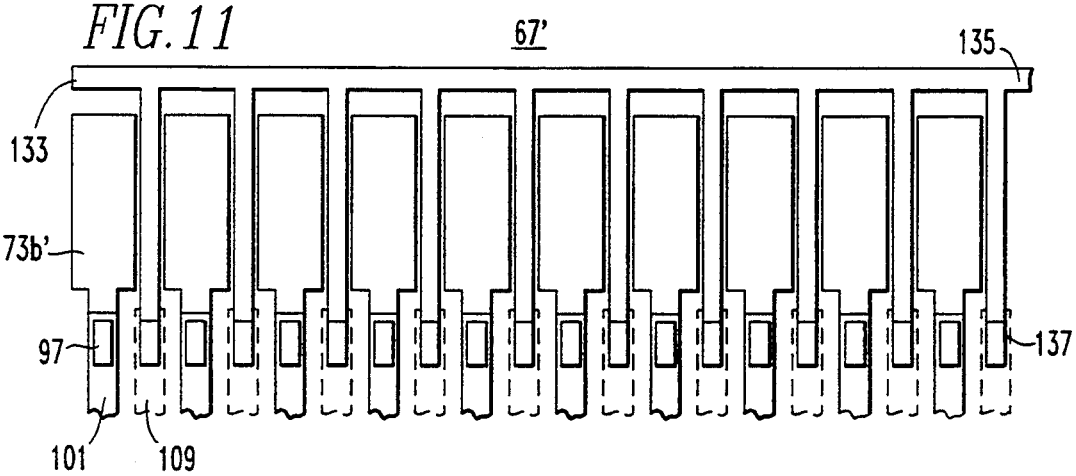
FIG. 11 is a fragmentary plan view of a modified embodiment of the detector array in accordance with the invention.

FIG. 11 shows a modified embodiment of the detector array 67'. In this array, the sensor electrodes **73*b'* of the Faraday cages are surrounded by a grounded electrode 133 to provide better channel separation. These electrodes 133 are grounded through the lead 135 and provide a path to ground for the capacitor ground electrodes 109 connected to the electrodes 133 through via 137**.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the appended claims and any and all equivalents thereof,

What is claimed is:

1. A solid state mass spectrograph for analyzing a sample gas, said mass spectrograph comprising:

a semiconductor substrate having a cavity therein with an inlet, a gas ionizing section adjacent said inlet, a mass filter section adjacent said gas ionizing section, and a detector section adjacent said mass filter section;

vacuum means evacuating said cavity and drawing said sample gas into said cavity through said inlet;

gas ionizing means in said gas ionization section of said cavity ionizing sample gas drawn into said cavity through said inlet to generate ionized sample gas;

mass filter means generating an electromagnetic field in said mass filter section of said cavity filtering by mass/charge ratio said ionized sample gas; and detector means detecting said filtering of said ionized sample gas.

2. The mass spectrograph of claim 1 wherein said sample gas has multiple gas constituents, and wherein said detector means comprises means simultaneously detecting a plurality of said multiple gas constituents.

3. The mass spectrograph of claim 1 wherein said detector means comprises an array of detector elements.

4. The mass spectrograph of claim 3 wherein said detector elements are arranged in a linear array.

5. The mass spectrograph of claim 4 wherein said detector means further comprises Faraday cage means connected with each detector element.

6. The mass spectrograph of claim 5 wherein said Faraday cage means comprise v-shaped conductors formed on said semiconductor substrate in said detector section of said cavity, and wherein said detector elements include signal generators located outside of said cavity and connected to said Faraday cage means.

7. The mass spectrograph of claim 6 wherein said semiconductor substrate is formed in two parts joined along parting surfaces extending through said cavity, and wherein said detector elements include signal generators located in recess means in said parting surface of one of said parts spaced from said cavity.

8. The mass spectrograph of claim 3 wherein said mass filter means comprises field generating means generating orthogonal magnetic and electric fields in said mass filter section of said cavity.

9. The mass spectrograph of claim 8 wherein said field generating means includes opposed electrodes formed on said substrate in said mass filter section of said cavity, and to which a voltage is applied to generate said electric field.

10. The mass spectrograph of claim 9 wherein said field generating means includes a magnet generating said magnetic field within said mass filter section of said cavity.

11. The mass spectrograph of claim 9 wherein said field generating means includes magnetic film formed on said substrate on opposed surfaces in said mass filter section of said cavity orthogonal to said opposed electrodes.

12. The mass spectrograph of claim 3 wherein said mass filter means comprises opposed primary electrodes on said substrate in said mass filter section of said cavity to which a voltage is applied to generate said electric field.

13. The mass spectrograph of claim 12 wherein said mass filter means further includes pairs of opposed trimming electrodes on said substrate in said mass filter section of said cavity between said opposed primary electrodes to which trimming voltages are applied to make said electric field substantially uniform within said cavity.

14. The mass spectrograph of claim 3 wherein said gas ionizing means comprises a solid state electron emitter formed in said substrate in said gas ionizing section of said cavity.

15. The mass spectrograph of claim 1 wherein said gas ionizing means comprises a solid state electron emitter formed in said substrate in said gas ionizing section of said cavity.

16. The mass spectrograph of claim 15 wherein said gas ionizing means further includes ion optic means comprising apertured partitions formed in said substrate in said gas ionizing section of said cavity.

17. The mass spectrograph of claim 1 wherein said semiconductor substrate has apertured partitions dividing said cavity into connected chambers extending from said inlet, and wherein said vacuum means is connected to said chambers to provide differential pumping of said cavity.

18. The mass spectrograph of claim 17 wherein said gas ionizing means comprises a solid state electron emitter formed on said substrate in said gas ionizing section of said cavity and ion optics comprising electrodes formed on selected of said apertured partitions.

19. A solid state mass spectrograph for analyzing a sample gas with multiple gas constituents, said mass spectrograph comprising:

a semiconductor substrate having an elongated cavity therein with an inlet, a gas ionizing section adjacent said inlet, a mass filter section adjacent said gas ionizing section, and a detector section adjacent said mass filter section, said substrate including apertured partitions dividing said cavity into connected chambers;

vacuum means differentially evacuating said connected chambers and drawing said sample gas into said cavity through said inlet;

gas ionizer means formed in said substrate in said gas ionizing section of said cavity and including a solid state electron emitter to which sample gas is drawn by said vacuum means and which generates ionized sample gas, and ion optic means comprising electrodes formed on selected of said apertured partitions and which collimate and accelerate said ionized sample gas;

a Wien filter generating orthogonal electric and magnetic fields in said mass filter section of said cavity which disperse said constituents of ionized sample gas by mass/charge ratio into a dispersion plane; and a linear detector array in said detector section of said cavity arranged in said dispersion plane simultaneously detecting a plurality of said multiple gas constituents.

20. The spectrograph of claim 19 wherein said linear detector array comprises a plurality of detector elements each comprising Faraday cage electrodes formed on said substrate and converging towards said dispersion plane, and detector cells formed in said semiconductor substrate removed from said cavity, and connected to said Faraday cage electrodes.

* * * * *